US007128602B1

(12) United States Patent
Cromwell et al.

(10) Patent No.: US 7,128,602 B1
(45) Date of Patent: Oct. 31, 2006

(54) MAKE FIRST BREAK LAST CONNECTION ASSEMBLY

(75) Inventors: Stephen Daniel Cromwell, Penryn, CA (US); Michael Alan Brooks, Sacramento, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/741,719

(22) Filed: Dec. 18, 2003

(51) Int. Cl.
*H01R 13/66* (2006.01)
*H01R 13/60* (2006.01)

(52) U.S. Cl. ..... 439/540.1; 439/924.1; 439/926; 439/248

(58) Field of Classification Search ..... 439/540.1, 439/181, 926, 924.1, 248, 188
See application file for complete search history.

(56) References Cited

U.S. PATENT DOCUMENTS 2,742,280 A * 4/1956 Wilcox ..... 160/189
4,305,633 A * 12/1981 Engberg et al. ..... 439/55
4,869,676 A 9/1989 Demler, Jr. et al. ..... 439/79
5,183,405 A 2/1993 Elicker et al. ..... 439/108
5,249,978 A 10/1993 Gazda et al. ..... 439/246
5,425,651 A 6/1995 Thrush et al. ..... 439/326
5,582,519 A 12/1996 Buchter ..... 439/101
6,095,839 A 8/2000 Kline ..... 439/224
6,493,782 B1 12/2002 Verdun et al. ..... 710/300
6,761,570 B1 * 7/2004 Patterson et al. ..... 439/188
2004/0189142 A1 * 9/2004 Knieser et al. ..... 310/309

* cited by examiner

*Primary Examiner*—Javaid H. Nasri

(57) ABSTRACT

A connection assembly permits a make first and break last connection for primary power. The assembly includes a first pair of connectors, a second pair of connectors, and a compliance element associated with one of the first pair of connectors. The compliance element enables the first pair of connectors to mate prior to the mating of the second pair of connectors and to enable the first pair of connectors to disengage after the disengagement of the second pair of connectors.

15 Claims, 3 Drawing Sheets

MAKE FIRST BREAK LAST CONNECTION ASSEMBLY

BACKGROUND OF THE INVENTION

In electronic systems, such as computer systems, it is often necessary to provide a computer with a redundant power source. In some computer systems, such as those used in the telephone industry, when power supplies are connected to their associated computers, they receive, through a primary connection, a fixed DC voltage such as −48 V DC and control signals through a secondary connection. The power supplies also provide various rail voltages to the computers through the secondary connection. The connections are facilitated by primary and secondary connectors carried by the computer system chassis and the power supplies.

Generally, to connect and disconnect redundant power sources, two conditions must be met. First, one side of the primary connection and one side of the secondary connection must float in a plane perpendicular to the connection axis, in either the power supply or computer system chassis, to enable the corresponding connectors to pick up and engage with their mating connectors without positional in-fighting or snubbing. Secondly, the primary connection must electrically make first and break last.

This second condition, contemplates that in these applications, it is essential that the primary connection be made prior to the secondary connection. This enables the power supply to connect to the primary DC voltage source provided by the computer before it is turned on and begins generation of secondary rail voltages. Likewise, when the power supply is disconnected from the computer, it is essential that the control signals turn off the secondary rail voltages by breaking the secondary connection before the primary source power is lost by disconnection of the primary connections. This sequence requires a make first break last connection assembly.

The foregoing sequence must be held under all tolerance conditions for the proper operation of the system. The combined tolerances of both their primary and secondary connectors can result in considerable wiping action requirements of the primary power connector to ensure the make first break last requirement. The present invention provides a make first break last connection assembly which meets the wipe requirements and reliability tolerances required in such applications.

SUMMARY OF THE INVENTION

At least one embodiment of the invention provides a connection arrangement including a first pair of connectors, a second pair of connectors, and a compliance element associated with one of the first pair of connectors. The compliance element enables mating of the first pair of connectors prior to mating of the second pair of connectors and disengaging of the first pair of connectors after the disengaging of the second pair of connectors.

A method embodiment of the invention comprises mounting first and third connectors on a first carrier, mounting second and fourth connectors on a second carrier so that when the first and second connectors are in axial alignment the third and fourth connectors are also in axial alignment, and compliantly urging one of the first and second connectors towards the other one of the first and second connectors for engagement prior to engagement of the third and fourth connectors.

These and various other features as well as advantages of the present invention will be apparent from a reading of the following detailed description and a review of the associated drawings.

DESCRIPTION OF THE INVENTION

In the following detailed description, reference is made to the accompanying drawings, which form a part hereof. The detailed description and the drawings illustrate specific exemplary embodiments by which the invention may be practiced. These embodiments are described in sufficient detail to enable those skilled in the art to practice the invention. It is understood that other embodiments may be utilized, and other changes may be made, without departing from the spirit or scope of the present invention. The following detailed description is therefore not to be taken in a limiting sense, and the scope of the present invention is defined by the appended claims.

Figure 1:
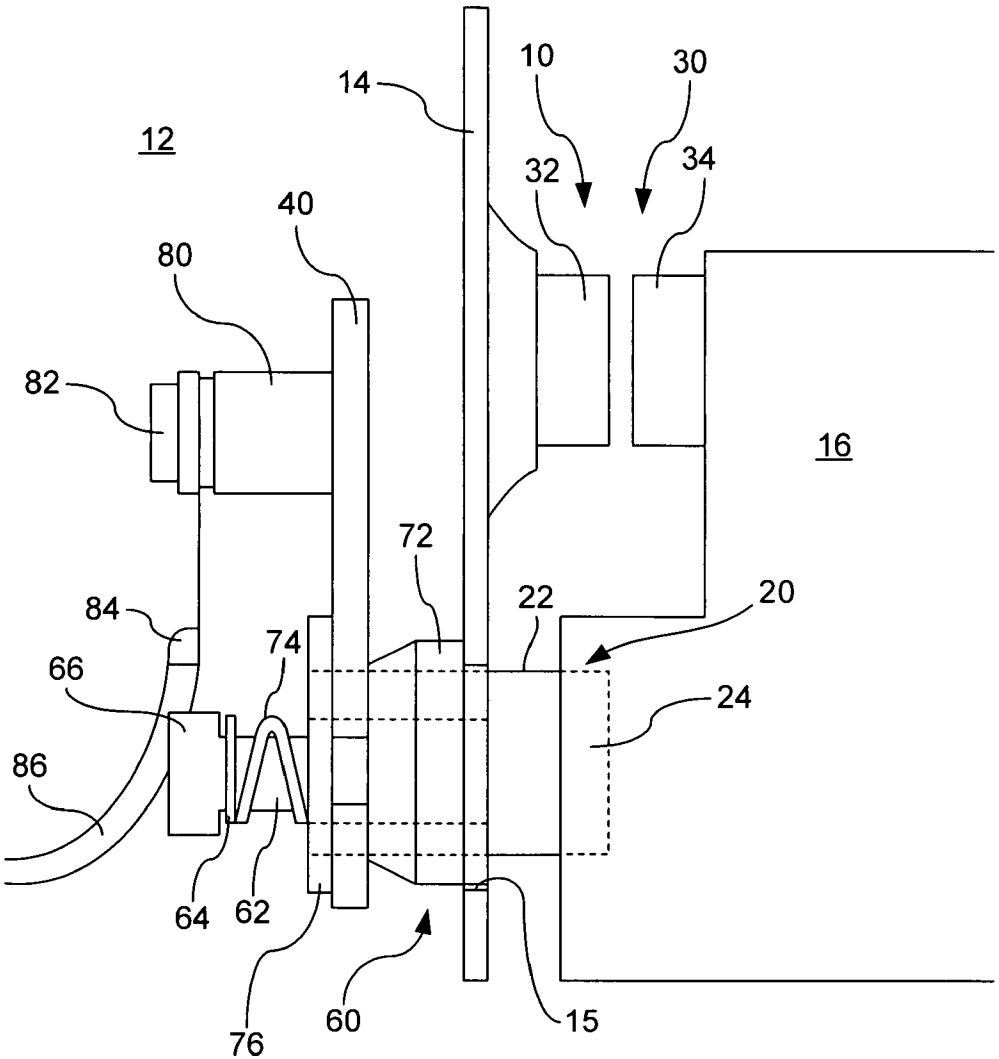
FIG. 1 is a partial side view, partially in cross section, of a connection assembly according to one embodiment of the present invention wherein a primary connection is made before a secondary connection.

FIG. 1, shows a connection assembly 10 that embodies the present invention. The connection assembly 10, as will be seen hereinafter, enables connection of a computer 12 having chassis wall 14 to a power supply 16. To that end, the connection assembly 10 includes a primary connector pair 20 and a secondary connector pair 30. The primary connector pair 20 includes a first connector 22 and a second connector 24. The secondary connector pair 30 includes a third connector 32 and a fourth connector 34.

Figure 2:
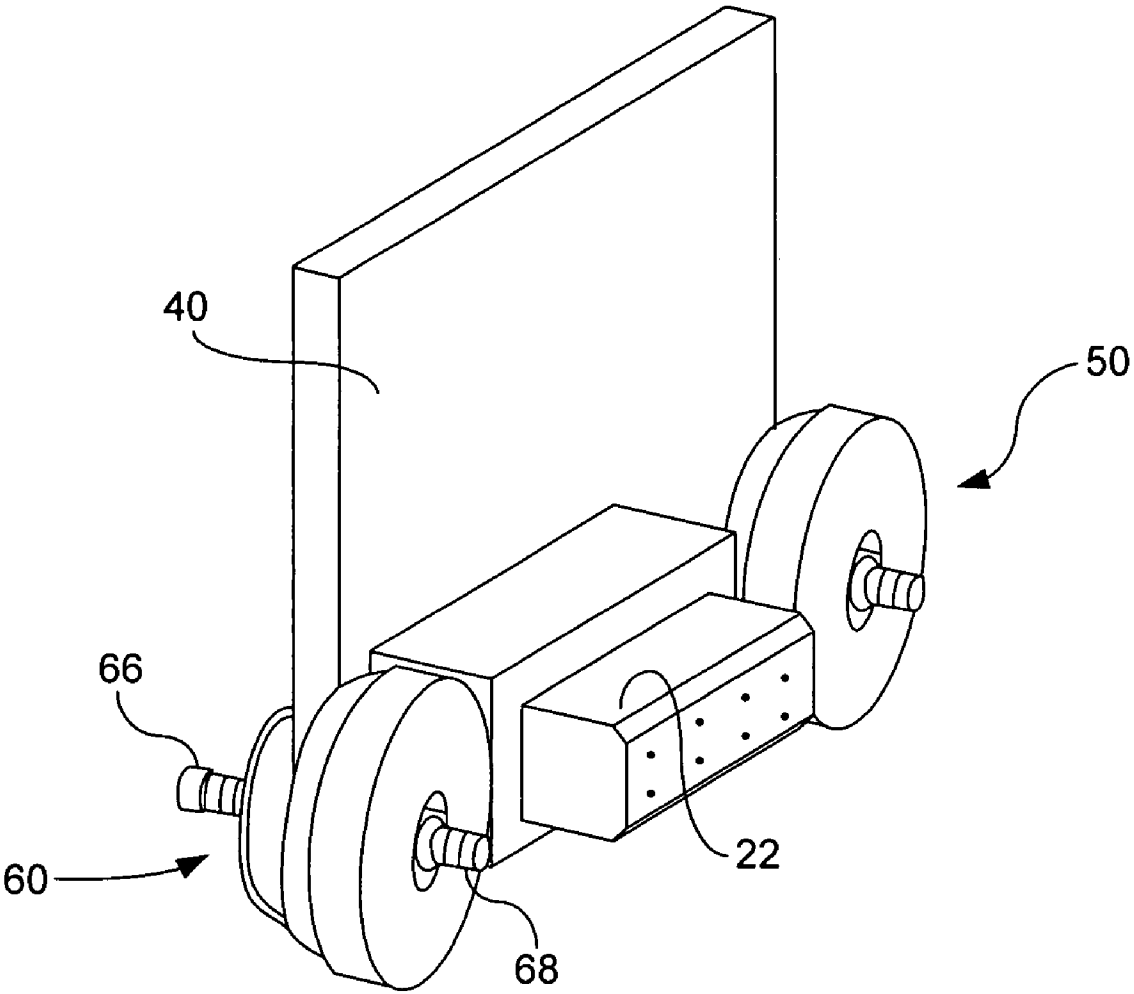
FIG. 2 is a perspective view of a primary connector assembly which may be utilized according to one embodiment of the present invention.

The first connector 22 is mounted on a printed circuitboard 40 which may also be seen in the perspective view of FIG. 2. The first connector 22 is fixed to the printed circuitboard 40.

The printed circuitboard 40 is mounted to the computer chassis 14 by a pair of mounts 50 and 60. Since each of the mounts 50 and 60 are substantially identical and mount 50 is hidden behind mount 60 in FIG. 1, only mount 60 will be described in detail herein.

Mount 60 includes a threaded screw 62 having a flange 64, a screw head 66, and a thread 68. The thread 68 permits the screw 62 to be threadingly received onto the computer chassis 14.

The screw 62 carries the printed circuitboard 40. It also carries a spacer 72 and a compliance element in the form of a biasing spring 74. The biasing spring 74 is carried by the screw 62 between the flange 64 and a washer 76. Alternatively, the flange 64 may be omitted and the biasing spring 77 may be between the screw head 66 and the washer 76.

The printed circuitboard 40 further carries a standoff 80 which is secured to the printed circuitboard 40. A mounting nut 82 is in electrical contact with a lug 84 which permits a conductor 86 to couple a fixed DC voltage, as for example, −48 V DC, to the printed circuitboard 40 and to the primary first connector 22.

The computer chassis 14 includes an opening 15 through which the connector 22 projects when the printed circuitboard 40 is mounted to the chassis 14 by the mounts 50 and 60 as illustrated. The biasing spring 74 serves to bias the connector 22 towards connector 24. As will be noted in FIG. 1, when the first connector 22 is in initial mating with the second connector 24, to thus connect the primary connectors, the secondary connectors 32 and 34 are still spaced apart. With the primary connectors mating prior to the secondary connectors, the power supply is first coupled to the DC power source before the supply is turned on.

The connector 32 is mounted on the chassis 14 and the connector 34 is mounted on the power supply 16 so that when connectors 22 and 24 are aligned, connectors 32 and 34 are also aligned. However, as can be clearly seen in FIG. 1, when connectors 22 and 24 first mate, connectors 32 and 34 are still spaced apart.

Figure 3:
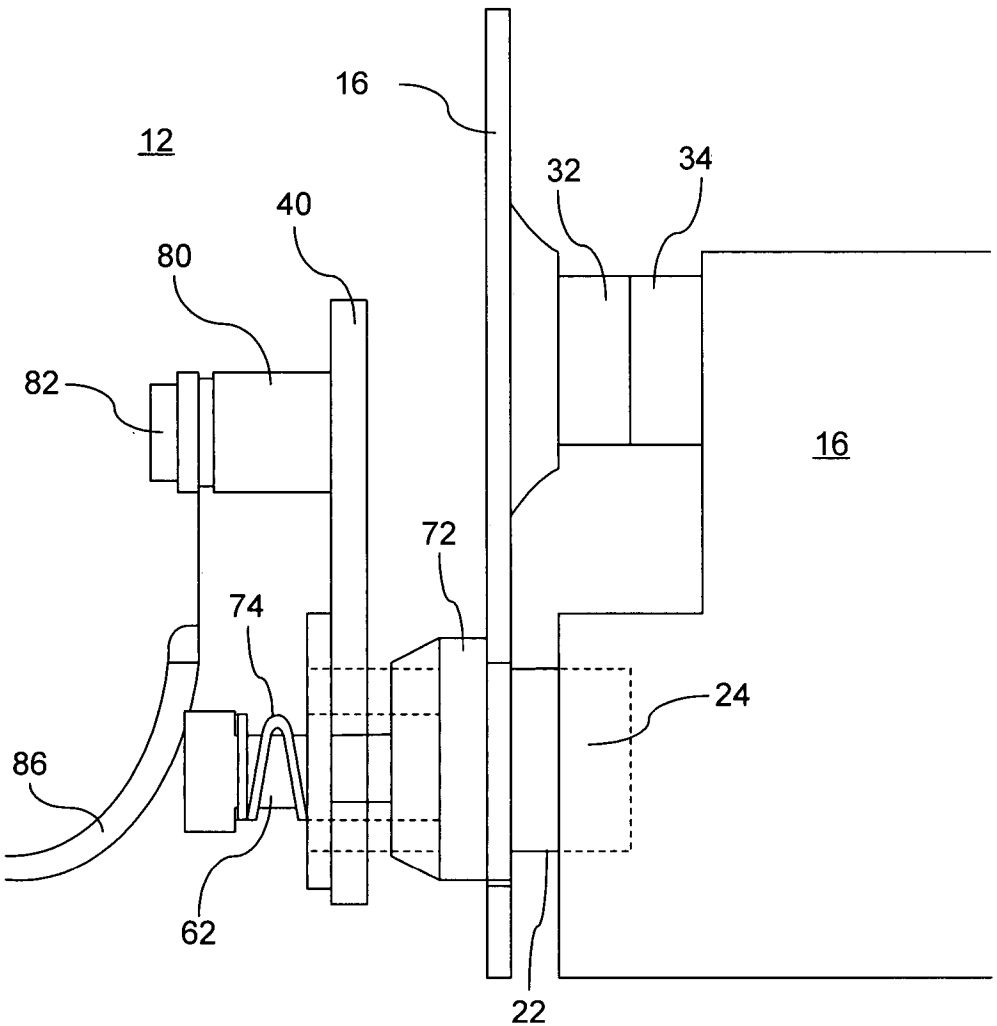
FIG. 3 is a partial side view, partially in cross section, of the connection assembly of FIG. 1 wherein both the primary and secondary connections are made.

As shown in FIG. 3, when the power supply 16 is further displaced towards the computer chassis 14, the secondary connectors 32 and 34 eventually mate. All the while, connector 22 is forced in the direction of movement of the power supply 16 relative to the computer 12 against the bias of spring 74. As a result, the primary connectors 22 and 24 will mate before the secondary connectors 32 and 34. As can be appreciated by those skilled in the art, connectors suitable for use in accordance with this embodiment are well known in the art and contain one or more contacts for making electrical mating connection.

When it is time to disconnect the power supply 16 from the computer 12, the foregoing sequence of events occur in the opposite order. First, the power supply 16 is displaced away from the computer 12 to disconnect the secondary connectors 32 and 34. Upon further movement of the power supply 16 away from the computer 12, the connector 22 and connector 24 will remain in contact until the connector 22 has reached the end of its travel as illustrated in FIG. 2. Then, upon further displacement of the power supply 16, the primary connectors 22 and 24 will disengage.

Hence, as may be seen from the foregoing, the connection arrangement 10 provides for a make first and break last connection of the first and second connectors 22 and 24, respectively. As previously mentioned, one of the connectors of the primary connector pair and one of the connectors of the secondary connector pair preferably floats in a plane perpendicular to the compliant movement of the printed circuitboard 40 and thus the connector 22. Such arrangements are well known in the art and need not be described herein.

The degree in which the connector 22 projects through the computer chassis wall 14 may be adjusted by adjusting the thickness dimension of the spacer 72. Hence, if an earlier primary connection is required, the spacer 72 may be made thinner.

Although the present invention has been described in considerable detail with reference to certain preferred embodiments, other embodiments are possible. Therefore, the spirit or scope of the appended claims should not be limited to the description of the embodiments contained therein. It is intended that the invention resides in the claims.

We claim:

1. A connection arrangement comprising:

a first pair of connectors;

a second pair of connectors;

a compliance element separate from the first and second pairs of connectors and associated with one of the first pair of connectors that enables mating of the first pair of connectors prior to mating of the second pair of connectors and disengaging of the first pair of connectors after disengaging of the second pair of connectors;

wherein the first pair of connectors comprise a first connector and a second connector and wherein the compliance element is a biasing element that biases the first connector towards engagement with the second connector; and a printed circuit board that carries the first connector.

2. The arrangement of claim 1 wherein the biasing element is a spring.

3. The arrangement of claim 1 wherein the biasing element acts upon the printed circuit board.

4. The arrangement of claim 3 further comprising at least one fastener that fastens to a chassis wall, wherein the printed circuit board is slidingly mounted on the at least one fastener and wherein the biasing element is carried by the at least one fastener and compliantly urges the printed circuit board toward the chassis wall.

5. The arrangement of claim 4 wherein the first connector extends from the printed circuit board and through an opening in the chassis wall.

6. The arrangement of claim 4 wherein the second pair of connectors comprise a third connector and a fourth connector, and wherein the third connector is carried by the chassis wall.

7. An assembly comprising:

a first pair of connectors including a first connector and a second connector;

a second pair of connectors including a third connector and a fourth connector;

a biasing element separate from the first and second pairs of connectors that biases the first connector towards the second connector that enables mating of the first and second connectors prior to mating of the third and fourth connectors and disengaging of the first and second connectors after disengaging of the third and fourth connectors; and a printed circuit board that carries the first connector.

8. The assembly of claim 7 wherein the biasing element is a spring.

9. The assembly of claim 7 wherein the biasing element acts upon the printed circuit board.

10. The assembly of claim 9 further comprising at least one fastener that fastens to a chassis wall, wherein the printed circuit board is slidingly mounted on the at least one fastener and wherein the biasing element is carried by the at least one fastener and compliantly urges the printed circuit board toward the chassis wall.

11. The assembly of claim 1 wherein the first connector extends from the printed circuit board and through an opening in the chassis wall.

12. The assembly of claim 10 wherein the third connector is mounted on the chassis wall.

13. A method for engaging first, second, third and fourth connectors comprising:

mounting first and third connectors on a first carrier wherein the mounting step includes fixing the first connector to a printed circuit board;

mounting second and fourth connectors on a second carrier so that when the first and second connectors are in axial alignment the third and fourth connectors are also in axial alignment; and compliantly urging, without the assistance of the connectors, one of the first and second connectors towards the other one of the first and second connectors for engagement prior to engagement of the third and fourth connectors.

14. The method of claim 13 wherein the first carrier includes a chassis wall and wherein the urging step includes projecting the compliantly urged connector through the chassis wall.

15. The method of claim 13 wherein the compliantly urging step includes biasing the printed circuit board.

* * * * *

UNITED STATES PATENT AND TRADEMARK OFFICE

CERTIFICATE OF CORRECTION

PATENT NO. : 7,128,602 B1
APPLICATION NO. : 10/741719
DATED : October 31, 2006
INVENTOR(S) : Stephen Daniel Cromwell et al.

It is certified that error appears in the above-identified patent and that said Letters Patent is hereby corrected as shown below:

In column 4, line 49, in Claim 11, delete "claim 1" and insert -- claim 10 --, therefor.

Signed and Sealed this

Twenty-ninth Day of December, 2009

David J. Kappos

David J. Kappos
*Director of the United States Patent and Trademark Office*